US008863402B2

(12) United States Patent
Ruokamo et al.

(10) Patent No.: US 8,863,402 B2
(45) Date of Patent: Oct. 21, 2014

(54) METHOD FOR DRYING OBJECTS OF ORGANIC MATERIAL AND A DRYER

(75) Inventors: Leo Ruokamo, Tervola (FI); Heikki Majava, Oulunsalo (FI)

(73) Assignee: CCM-Power Oy, Oulunsalo (FI)

( * ) Notice: Subject to any disclaimer, the term of this patent is extended or adjusted under 35 U.S.C. 154(b) by 918 days.

(21) Appl. No.: 12/993,863

(22) PCT Filed: May 22, 2009

(86) PCT No.: PCT/FI2009/050425

§ 371 (c)(1),
(2), (4) Date: Jan. 10, 2011

(87) PCT Pub. No.: WO2009/141507

PCT Pub. Date: Nov. 26, 2009

(65) Prior Publication Data

US 2011/0138647 A1 Jun. 16, 2011

(30) Foreign Application Priority Data

May 21, 2008 (FI) ..... 20085479

(51) Int. Cl.

| | |
|---|---|
| ***F26B 3/08*** | (2006.01) |
| ***F26B 21/04*** | (2006.01) |
| ***F26B 3/00*** | (2006.01) |
| ***F26B 17/26*** | (2006.01) |
| ***F26B 25/00*** | (2006.01) |

(52) U.S. Cl.

CPC . *F26B 21/04* (2013.01); *F26B 3/00* (2013.01); *F26B 17/26* (2013.01); *F26B 25/002* (2013.01); *F26B 2200/02* (2013.01); *F26B 2200/24* (2013.01)

USPC ..... 34/360; 34/504; 34/507

(58) Field of Classification Search

CPC ..... F26B 3/02; F26B 3/04; F26B 3/06

USPC ..... 34/360, 504, 507

See application file for complete search history.

(56) References Cited

U.S. PATENT DOCUMENTS

| | | | |
|---|---|---|---|
| 2,688,807 | A | 9/1954 | Ginther |
| 2,934,830 | A | 5/1960 | Zvejnieks |

(Continued)

FOREIGN PATENT DOCUMENTS

| | | | |
|---|---|---|---|
| CH | 354026 | | 4/1961 |
| DE | 10216496 | | 10/2003 |
| RU | 2256133 | C1 | 7/2005 |
| WO | 2007/061352 | | 5/2007 |

OTHER PUBLICATIONS

International Search Report, dated Sep. 22, 2009, in PCT application.

(Continued)

*Primary Examiner* — Kenneth Rinehart
*Assistant Examiner* — Gajanan M Prabhu
(74) *Attorney, Agent, or Firm* — Young & Thompson

(57) ABSTRACT

A dryer for drying objects of material has a container-like body. The body is substantially tight and material to be dried can be fed into it. The body may be substantially upright or inclined. The material to be dried is fed at the lower part of the body is discharged from the upper part thereof and drying gas is directed to the dryer substantially at the upper part of the body and taken off from the lower part thereof. This is achieved by shut-off arrangements of the feeding and discharge of the material to be dried and by the structure of the body. The drying gas circulates in the dryer in a substantially closed circulation. The drying gas taken off from the lower part of the body is heated by element of a heating device and the heated drying gas is fed to the upper part of the body.

13 Claims, 3 Drawing Sheets

(56) References Cited

U.S. PATENT DOCUMENTS

Figure 1:
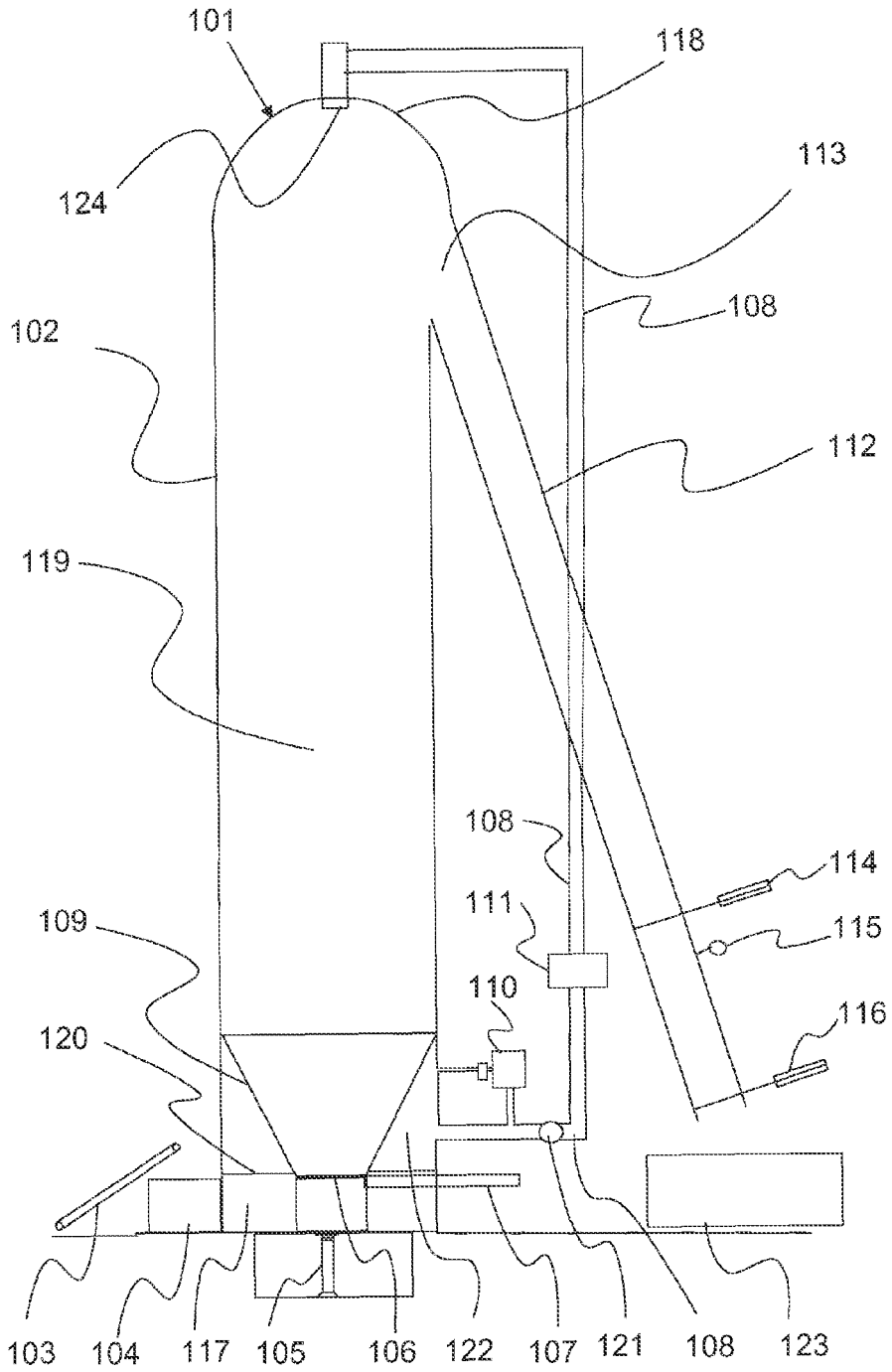

| | | | | |
|---|---|---|---|---|
| 3,391,472 | A | 7/1968 | Landers | |
| 3,432,940 | A | 3/1969 | Ronceray | |
| 3,618,227 | A | 11/1971 | Breakell et al. | |
| 4,209,537 | A * | 6/1980 | Wood | 426/233 |
| 6,370,797 | B1 | 4/2002 | Crawford | |
| 2005/0050749 | A1 | 3/2005 | Hauch | |
| 2008/0209755 | A1 * | 9/2008 | Shivvers | 34/363 |

OTHER PUBLICATIONS

Search Report, dated Nov. 2, 2009, in Finnish application No. 20085479.

Russian Office Action, dated Apr. 24, 2013, from corresponding RU application.

* cited by examiner

METHOD FOR DRYING OBJECTS OF ORGANIC MATERIAL AND A DRYER

The invention relates to a dryer for drying objects of material, which dryer has a container-like body that is in a substantially vertical or inclined position, and to a method for drying objects of material in which method the material to be dried is dried in a dryer which has a container-like body that is substantially in an upright position or in an inclined position.

When using material that is to be burned, from the viewpoint of the user one of the most significant quality factors is the dryness of the material. A conventional way to reduce the moisture of for example wood to be burned, such as logs or chopped wood, is to dry them in heaps or piles for a year or two. The drying can take place indoors or outdoors. Variations in the quality of the material to be filed, moulding, possible occurrence of pest insects, appearance drawbacks and the seasonal nature of the production cause problems. The low turnover of the stock and the large facilities required by a larger scale drying also become obstacles to a commercial use.

In order to speed up and to intensify the drying, dryers have been made that use air flow and/or heating.

In cold-air drying, atmospheric air is blown through the material to be dried. An advantage of the method is that it is rather inexpensive and requires simple structures. For a proper industrial drying it is too slow and too dependent on the temperature and the humidity of the atmospheric air being used. Also the sizes of the dryer and the storage facilities become unpractically large.

When heating the drying gas and blowing it through the material to be dried the drying takes place faster than by using an unheated gas. The quality of the dried material is improved and the final moistures are lower. However, the dryers become more complex and more expensive than the cold-air drying devices.

Container-like dryers using a heated drying gas are known, which dryers are filled with material to be dried and after the material has reached a desired dryness, the container is emptied. Also dryers are known in which the material to be dried is in cages that are movable in the dryer in respect of the air flow, and a cage in which the material has dried is removed from the dryer, and a cage in which there is material to be dried is added therein. However, these dryers are slow to use and require a lot of measures and monitoring. Furthermore, the drying process has to be stopped during discharging and filling.

The patent publication U.S. Pat. No. 3,391,472 discloses an apparatus made for cooling and drying of pellets wherein the pellets are fed from below to a vertical dryer which has box-like means for elevating the pellets upwards inside the dryer. In the upper part of the dryer, there is a fan which sucks air through the dryer, whereby air flows in the same direction as the pellets. Air is introduced to the dryer at the lower part of the dryer. In the upper part of the dryer, the pellets are emptied and discharged from the dryer. In the patent publication U.S. Pat. No. 3,432,940, an apparatus for drying sand and corresponding material is known. It substantially contains a vertical dryer in which the material to be dried is conveyed upwards from below by means of holders attached to the conveyor belt. The drying air is removed from the upper part of the dryer and introduced to the dryer at the lower part thereof, in the example of the publication, next to the feed point of the material. The drying effect of an air flow has been intensified by constructing a guide that guides the air flow to travel so that the material is dried better. Here, it has been attempted to provide a system in which a better drying effect could be achieved with the same amount and speed of air whereby the material to be dried is prevented from taking off with the air flow. In these solutions, a part of the heat of the drying air is wasted when it exits the dryer. Also the described solutions have a lot of wasted space for which air has to be heated, and they increase the size of the apparatus.

The patent publication U.S. Pat. No. 6,370,797 discloses a dryer functioning on a counter current principle. It aims to dry granulate material, plastic pellets are used as an example. The pellets travel in a vertical dryer under gravity from the top downwards and the drying gas is directed against the travel direction. Also patent publication WO2007/061352 discloses a counter current type dryer. It has been designed for drying for example saw dust or a corresponding fine-grained material. Here, the material to be dried is conveyed from the top downwards by means of a spiral conveyor and the drying air is directed from below upwards. In these arrangements, there is unused space and their application to the drying of various materials is difficult.

An aim of the invention is a solution by which the drawbacks and disadvantages relating to the prior art can considerably be reduced. Additionally, by means of the invention the drying of objects of material becomes more economical.

The aims of the invention are obtained with a method and a dryer, which are characterized in what is presented in the independent claims.

Some advantageous embodiments of the invention are presented in the dependent claims.

In the method according to the invention, a dryer to be used for drying of objects of material has a container-like body. The body is substantially tight and material to be dried can be fed into it. The body is substantially in an upright position or in an inclined position. The position of the body is defined by the flow direction of the material to be dried, i.e. the material to be dried flows substantially in the direction of the body. The method works on a counter current principle, i.e. the drying gas travels against the material to be dried. The material to be dried is fed to the lower part of the body and the material to be dried is discharged from the upper portion of the body and the drying gas is directed to the dryer substantially at the upper part of the body and taken off from the lower part of the body.

In the method according to the invention, the drying gas circulates in the dryer in a substantially closed circulation. The drying gas taken off from the lower part of the body is heated by means of a heating device and the heated drying gas is fed to the upper part of the body. The drying gas carries the water vapour released from the material to be dried in the upper part of the dryer to the lower part of the dryer, where the water vapour is condensed to the surface of the material to be dried, releasing simultaneously heat to the material to be dried. Objects of material to be dried are preferably organic matter, such as logs of wood, wood chips, pellets, saw dust or corresponding material or raw material suitable as solid fuel. The method and the apparatus can be applied also to drying of material other than the ones suitable as fuel. When objects of material to be dried are fed into the body at the lower part thereof, the material having undergone the drying process is discharged from the upper part of the body.

In a dryer for drying objects of material according to the invention, a gas circulating in the dryer functions as the drying agent. Preferably, this gas is heated. The body of the dryer is container-like and it is substantially vertical or in an inclined position. The body is hollow and the drying process takes place inside it. The space where the drying process takes place is a drying space. The body is tight and preferably cylindrical. The material to be dried is fed to the dryer at the lower part thereof and it travels inside the body from the bottom upwards. The drying gas travels inside the body from the top downwards. The drying gas is fed into the body of the dryer at the upper part thereof and it exits from the lower part of the body. Substantially in the upper part of the body of the dryer, there are means for feeding drying gas into the body, and in the lower part of the body, there are means for taking the drying gas off.

In an embodiment of the dryer according to the invention, the inner parts of the body form a substantially closed space. This has been achieved by means of shut-off arrangements of the feeding arrangement and the discharge arrangement of the material to be dried as well as by means of the structure of the body. In this closed space, mainly the same drying gas is circulated, whereby a closed circulation is obtained for the drying gas. Preferably, the gas is heated during circulation.

In another embodiment of the dryer according to the invention, the drying gas is heated by means of a heating device. It is connected to the circulation system of the drying gas. There are several different implementations for the heating device. One implementation is a gas-heated hot-air furnace. Here, the gas is heated so that it is not in direct contact with the flame of the gas. Other alternatives can be any kinds of heating: such as for example a heat exchanger, a burner or a resistor. Usually, the quickest drying is achieved if a heating system, with which the drying gas can be heated considerably above the temperature of vaporisation of water, is used as a heating device.

In a third embodiment of the dryer according to the invention, the circulation system of the drying gas has one or several valve arrangements for adding drying gas into the circulation system or for removing it from the circulation system.

In an embodiment of the dryer according to the invention, the drying gas transforms the moisture present in the material to be dried into vapour. The vapour travels with the flow of the drying gas in the dryer from the top downwards. In the lower parts of the dryer, the vapour meets the newly entered material to be dried that is cool. The vapour is condensed as moisture to the surface of the material. In this process, heat is transferred to the material to be dried. Even though the material to be dried gets even moister here, the achieved advantages are the warming up of the material and also in case of wood material the fact that the surface parts of an object of material are expanded as they get wet, whereby the drying process in the inner parts of the object takes place more easily.

In an embodiment of the dryer according to the invention, there is in the lower part of the body a sieve arrangement for allowing the drying gas and water to pass through. The sieve arrangement is preferably more or less in the form of a funnel opening towards the upper part of the body and located above the feeding arrangement of the material to be dried. The drying gas is transferred inside the body through the sieve arrangement to the gas removal area. The drying gas is removed from the body in the gas removal area. Preferably, the gas removal area is located underneath the sieve arrangement.

In an embodiment of the dryer according to the invention, the sieve arrangement is arranged to be movable in the direction of the longitudinal axis of the dryer body. With this arrangement, the material in the dryer can be moved so that wedging of the material to be dried against the walls of the dryer occurs as little as possible. Preferably, the sieve arrangement is arranged to move simultaneously with the feeding device of the material to be dried.

In an embodiment of the dryer according to the invention, the cross-sectional area of the inner surface of the dryer body, i.e. of the drying space, is growing in the direction of travel of the material to be dried. In this case, the cross-sectional area of the drying space is larger in the upper part of the body than in the lower part thereof. Increasing the cross-sectional area in the travel direction of the material to be dried prevents wedging of the material to be dried against the walls of the drying space and decreases transfer friction.

The dryer according to the invention is preferably suited for drying of objects of material. In this case, the drying gas can easily pass between the objects of material. Objects of material to be dried are preferably organic matter, such as logs of wood, wood chips, pellets, saw dust, peat, briquettes, pressed pieces made of organic material, or the like. Usually, this material to be dried is meant to be burned after drying but also other uses are possible, such as building or isolating.

An advantage of the invention is that with it, a dryer can be obtained that can be used, if needed, in a continuous, fast and cost-effective manner. This enables the industrial manufacture of for example biofuel out of the material to be dried.

An advantage of the invention is also that it utilizes the heat generated by the condensation of water vapour.

A further advantage of the invention is that with it, different temperatures can easily be used in drying, whereby the dryer can be arranged to dry different types of materials and different materials.

Yet another advantage of the invention is that in the dryer according to the invention, higher temperatures of the drying gas can be used compared to conventional drying methods. The high temperature of the drying gas has several cost-reducing factors affecting the drying process. The surface moisture of the material to be dried is high in the stage of condensation of the water vapour. This improves the transfer of heat to the object to be dried. As the temperature of the object to be dried grows, the transfer of the water from the inner parts of the object to the surface parts speeds up. The flow rates of the drying gas can be decreased by lowering the blowing power, whereby the flow rate of the drying gas in the material to be dried is decreased.

Further, the invention reduces the need for storage facilities and speeds up the treatment of the material to be dried.

An advantage of the invention is also that different types of materials and materials having different moisture levels can easily be dried by adjusting travel of the material to be dried as well as the speed of circulation and the temperature of the drying gas. An advantage is also that the dryer according to the invention can be implemented so that the drying space is full of material to be dried, whereby the drying gas passes through the material to be dried so that there are no channels that would pass around the material to be dried.

In the following, the invention will be described in detail. In the description, reference is made to the appended drawings, in which FIG. 1 shows by way of an example an embodiment of the dryer according to the invention and FIG. 2 shows by way of an example another embodiment of the dryer according to the invention.

Figure 3:
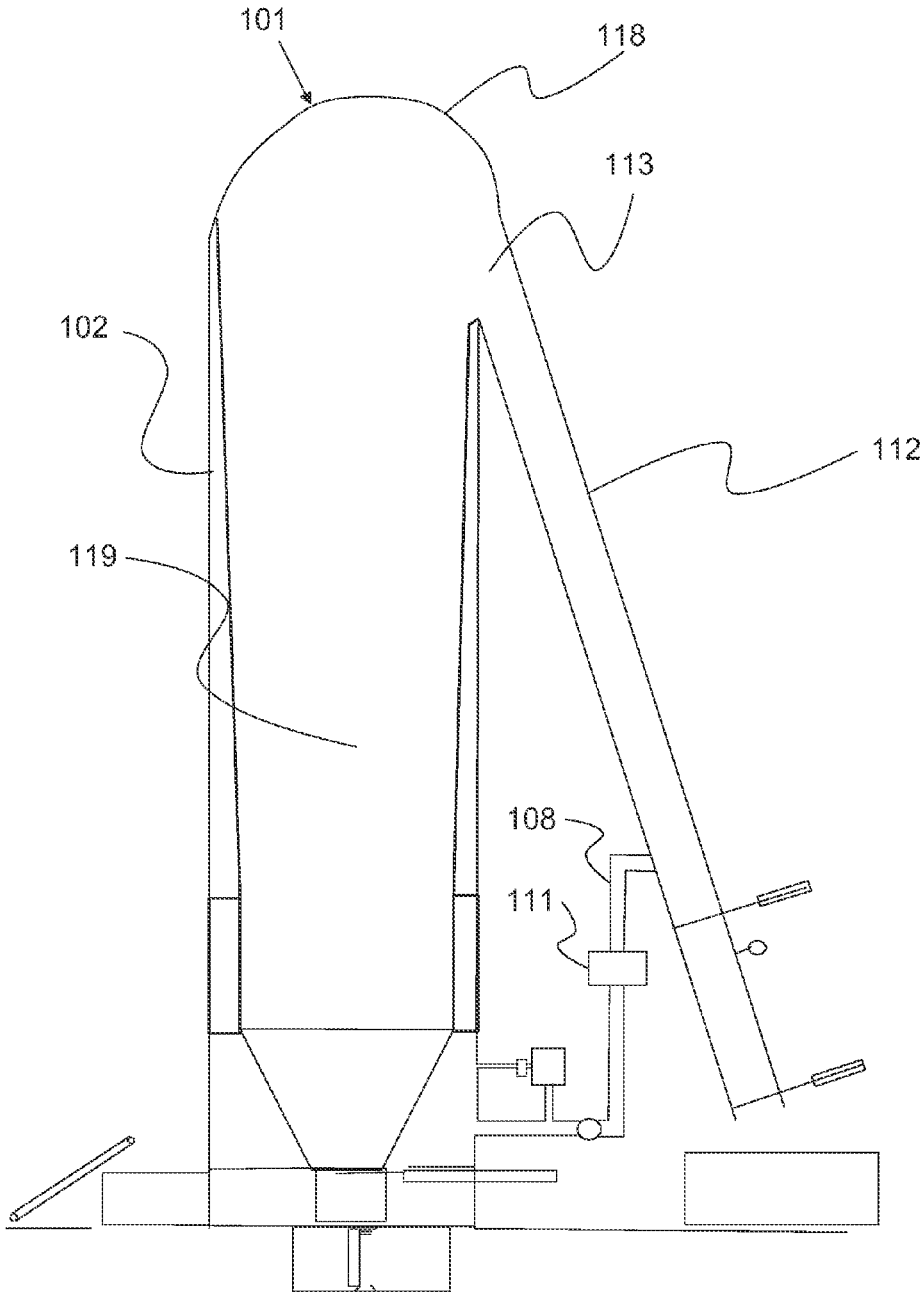

FIG. 3 shows, by way of example, another embodiment of the dryer according to the invention.

Figure 2:
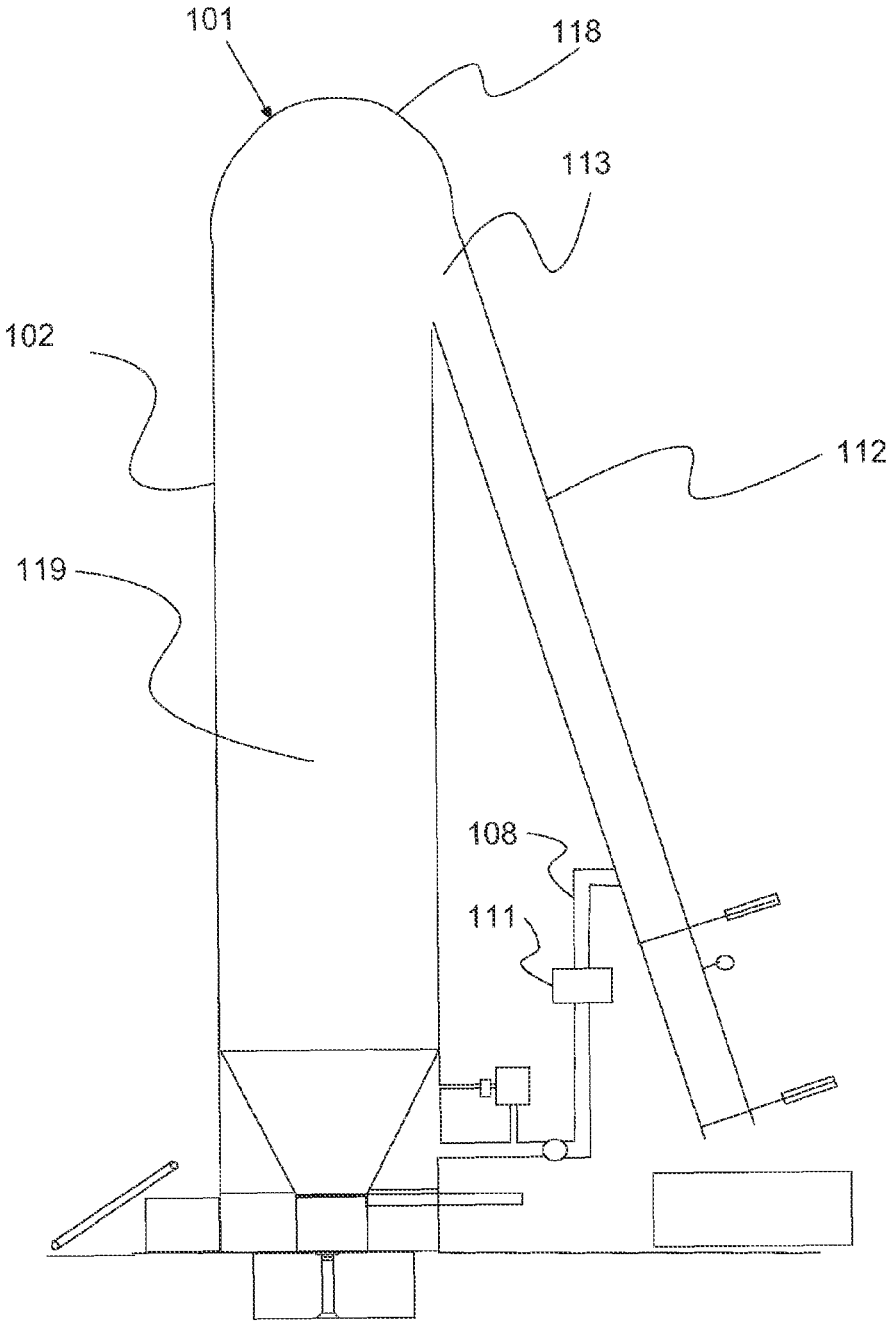

FIG. 1 shows by way of an example an embodiment of the dryer according to the invention. The dryer 101 has a vertical body 102. The body is container-like and material to be dried can be fed into it. The body is substantially tight. It is made of metal, plastic, glass fiber, or a combination thereof or another material suited for the purpose that sustains wear and temperature changes. The body may have heat insulation that reduces transfer of heat to the outside of the dryer. Inside the dryer body, there is a drying space 119 and a feeding space 117. The drying space and the feeding space are separated from each other by means of a separator structure 120 so that as little as possible drying gas and water released in the drying process from the material to be dried can enter from the drying space into the feeding space. The separator structure has an opening for transferring material to be dried from the feeding space into the drying space. The feeding space in the embodiment according to the example is below the drying space. The surface of the separator structure 120 facing the drying space is preferably designed so that it guides the water released from the material to be dried to a location wherefrom the water can be removed from the inside of the body in a controlled manner. Preferably, the water removal is performed so that no drying gas is removed simultaneously from the body.

The body of the dryer is substantially in an upright position or in an inclined position. The cross-sectional form of the body can be circular, oval, trough-shaped, polygonal, or a combination of several forms. The cross-sectional form of the body can be chosen depending on in which position it is intended to be used. For example, when the body is in an upright position or more or less in an upright position, a substantially circular cross-section is a preferable solution, because then the inner surface of the dryer does not form angles to which the material to be dried could accumulate and the gas flow remains more or less even. When the body is inclined, the cross-section can be oval or hemispherical. Inclining the body can be useful for example when locating the dryer in an industrial hall the height or other structures of which are restrictive. In that case, the height of the dryer is reduced and no concessions need to be made to its length. Thereby, also the lifting height of the material to be dried is reduced and a lifting arrangement 105 can be selected to have a lower power than a lifting arrangement in a dryer that is otherwise of equal length but in an upright position.

The cross-sectional area of the dryer body 102 can grow in the direction of the flow of the material to be dried, i.e. the cross-sectional area can be larger in the upper part of the dryer than in the lower part thereof, as shown in FIG. 3. In this case, wedging of the material to be dried against the walls of the body can be decreased and the friction of the material to be dried in the transfer can be reduced.

The ratio of the cross-sectional area of the dryer to the length of the drying channel can be changed to the dimensions required by the material to be dried and the drying power of the dryer. If the cross-sectional area is increased and the length of the drying channel is shortened, the flow resistance of the drying gas in the material to be dried is decreased. This type of dryer is suited for material to be dried with a small object size, such as saw dust. For other materials, other kind of ratios are possible.

In the lower part of the body 102, there is a feeding arrangement for feeding the material to be dried into the body. In the case according to the example, it consists of a filling device 103, a transfer means 104 of the material to be dried, a lifting arrangement 105, a feed shut-off arrangement 106 and an actuator device 107 of the feed shut-off arrangement. The filling device can be for example like a conveyor belt-like conveyor, which carries the material to be dried to the transfer means. The transfer means of the material to be dried is in this case a carriage-like arrangement that is open from the top and has sides and a movable bottom. The feed shut-off arrangement is in the middle of a separator structure 120. By moving the feed shut-off arrangement by means of the actuator device 107 of the shut-off arrangement, an opening in the separator structure can be opened and closed. The lifting arrangement 105 is substantially below the opening in the separator structure. The lifting arrangement is preferably hydraulically operated.

The transfer means 104 of the material to be dried is arranged to transfer material to be dried from the outside of the dryer from below the second end of the feeding device inside the body into the feeding space 117. The transfer means of the material to be dried is arranged to travel by means of rails, carriages, rolls, a belt, or a corresponding arrangement. When the transfer means of the material to be dried is sufficiently full of material to be dried, it is moved to the feeding space. The transfer means of the material to be dried is of such size that it is placed below the feed shut-off arrangement 106 so that the upper edges of the sides of the transfer means for material to be dried are in contact with the separator structure 120. The upper edges of the transfer means of the material to be dried and the edges of the feed shut-off arrangement are arranged to be in a substantially tight contact with each other. This has been achieved with gaskets, rail arrangements, compatible grooves and projections, or in any other appropriate manner. When the transfer means of the material to be dried is below the feed shut-off arrangement, the shut-off arrangement 106 can be opened with the actuator device 107 of the shut-off arrangement. When the shut-off arrangement is open, the movable bottom of the transfer means 104 of the material to be dried is lifted with the lifting arrangement 105, whereby the material to be dried present in the transfer means moves to the drying space 119 of the dryer. The actuator device of the shut-off arrangement closes the feed shut-off arrangement and the material to be dried stays in the drying space. Then, the lifting arrangement can return to its lower position and release the transfer means of the material to be dried, which can be transferred to the outside of the dryer for refilling.

The transfer and feeding arrangement of the material to be dried into the dryer can also be arranged for example with a combination of a screw conveyor or screws and hydraulic apparatuses. By means of different transfer and feeding arrangements, material flows and their travel can be arranged to suit the drying process of the material to be dried.

In the lower part of the drying space 119, there is a sieve arrangement 109. The openings of the sieve arrangement are dimensioned so that they allow water and drying gas to pass but the material to be dried is not able to pass through the sieve arrangement. In an embodiment according to the example, the sieve arrangement is in the form of a truncated cone surface. The wider end of the sieve arrangement is in the form of the cross-section of the dryer and the edges of the wider end reach up to the inner surface of the dryer body. The edges of the narrower end of the sieve arrangement are arranged so that the opening shielded by the shut-off arrangement 106 located in the separator structure 120 remains on the inside of the area delimited by the edges of the narrower end of the sieve arrangement. In this case, the sieve arrangement as such will not disturb the feeding of the material to be dried into the dryer. In an embodiment of the invention, the sieve arrangement is movable in the direction of the longitudinal axis of the dryer body. The moving of the sieve arrangement takes place preferably simultaneously with the moving of the lifting arrangement so that when lifting material to be dried with the lifting arrangement to the drying space of the dryer, also the sieve arrangement moves in the direction of the flow of the material to be dried. By moving the sieve arrangement, wedging of the material to be dried against the walls of the dryer body is reduced. The moving mechanism of the sieve arrangement may have been implemented for example by combining the sieve arrangement to the lifting arrangement 105, but also other implementations are possible. The sieve arrangement separates the drying space 119 from a gas removal area 122 in which there is no material to be dried. At this gas removal area the drying gas is removed from the body. Also, the removal of water released from the material to be dried in the drying process from the dryer takes place in this area. The moving mechanism of the sieve arrangement has been implemented so that no material to be dried can enter the gas removal area. The sieve arrangement can also be implemented in other ways depending on the position of the dryer body and on the feeding arrangements of the material to be dried.

Usually when using the dryer, the drying space 119 is full of material to be dried from the sieve arrangement 109 up to the discharge arrangement of the material to be dried, which in the case of the example has been implemented by an opening arrangement 113 and a discharge tube 112. Gravity places the material to be dried so that within the material to be dried, there remain no channels through which the drying gas could pass by the material to be dried.

The drying gas that has travelled through the drying space of the body via a gas transfer arrangement 108 is removed from the body. The gas transfer arrangement takes the drying gas off at the gas removal area 122. The motion of the gas is maintained by means of a gas moving arrangement 121. This is a motor, a pump or a corresponding mechanism for moving the drying gas. This is prior art technique known as such. Preferably, gas removed from the body is reintroduced into the body, whereby the drying gas has a substantially closed circulation. The drying gas is heated with a heating arrangement 111. The heating arrangement is a hot-air furnace, a heat exchanger, a heating resistor, a burner or some other solution. For example, if the dryer produces fuel to a generator, the heat generated therein can be used in the dryer for heating the drying gas, or the use of the waste material of the production of the dryer for heating. The heating arrangement and the moving arrangement of the drying gas are arranged to work so that the flow of the drying gas through the dryer and the temperature of the drying gas can be adjusted according to the requirements of the drying process. For example, if the moisture of the material to be dried is higher than usual, the flow and the temperature of the drying gas can be increased so that the desired drying result could be obtained. Also, the temperature and the flow of the drying gas can be adjusted according to the size of the objects of material. In an embodiment of the example, the gas heated with the heating arrangement is reintroduced into the body at the upper part of the body through an opening arrangement 124.

In connection with the gas transfer arrangement 108, there is a valve arrangement 110, in which the amount of the drying gas present in the dryer can be adjusted. The valve arrangement can be made of one or several valves. The adjustment may have been implemented automatically or manually, or as a combination thereof. The valve arrangement has a connection to the gas removal area, through which connection drying gas can be removed away from the dryer. The valve arrangement additionally has a connection to the gas transfer arrangement through which gas can be added to the circulation of the drying gas.

At the upper part of the body 102, there is an opening arrangement 113 which allows having a connection to the discharge tube 112 of the material to be dried. In the discharge tube of the material to be dried, there is an upper end and a lower end, and the discharge tube is in the embodiment of the example arranged so that as the material to be dried ends up to the opening arrangement, it falls under gravity down from the upper end of the discharge tube of the material to be dried towards its lower end wherefrom it is discharged. In the discharge of the material to be dried also active methods can be used. If the cross-sectional area of the upper part of the body is large, for example scraping technique can be used in the discharge of the material to be dried from the body. In the upper part of the dryer, there can then be a rotating shaft equipped with a scraper with which the upper part of the layer of the material to be dried is scraped and guided to the opening arrangement. Also other mechanical transfer systems are possible, such as for example screw conveyors, conveyor belt-type conveyors, pushers, and different systems making use of transfer systems and gravity.

In the discharge tube of the material to be dried, there is in its lower part a shut-off arrangement of the discharge arrangement, which shut-off arrangement is made of a first 114 and a second shutter 116, of which the second shutter is closer to the lower end of the discharge tube. Between the first and the second shutter, there is a detector means 115. The detector means detects if the discharge tube is filled up to the detector means. Further, it has means for guiding the first and the second shutter.

The first 114 and the second shutter 116 of the discharge tube 112 of the material to be dried prevent the drying gas from being removed together with the material to be dried. Generally when the dryer is being used, always one of the shutters is closed. When the second shutter is closed and the first shutter is open, the material to be dried travelling in the discharge tube stops behind the second shutter. When so much material to be dried has accumulated to the lower end of the discharge tube that there is material to be dried at the detector means 115, the detector means detects that the discharge tube is filled up to it. The detector means issues an order to the first shutter to close. When the first shutter is closed, the detector means issues an order to the second shutter to open, whereby the material to be dried present in the discharge tube above the second shutter falls down from the discharge tube. Below the discharge tube, there is a transfer arrangement for transferring the material to be dried to further treatment, storage or use. In an embodiment according to the example, this transfer arrangement is a transport carriage 123. When the material to be dried has been discharged from the discharge tube, the second shutter is closed and thereafter, the first shutter is opened. Then, material to be dried starts again to accumulate above the second shutter. The shut-off arrangement of the discharge arrangement can also be implemented in other ways.

The gas transfer arrangement 108 feeds drying gas heated with a heating arrangement into the drying space 119 inside the body. The heated drying gas is introduced to the upper part of the drying space from one or several opening arrangements present in the body. In the case according to the example, the drying gas is arranged to enter the drying space through an opening arrangement 124 present at the top of the dryer. The upper part 118 of the body 102 of the dryer 101 is designed so that it guides the flow of the gas to be dried evenly among the material to be dried. Since the gas transfer arrangement 108 removes drying gas from the gas removal area 122 from the lower part of the dryer and feeds drying gas through an opening arrangement 124 to the upper part of the dryer, the drying gas flows through the drying space and simultaneously through the material to be dried from the top downwards.

The discharge arrangement of the material to be dried and the gas transfer arrangement 108 can be combined arrangements. An embodiment of this kind is shown in FIG. 2. In this embodiment, the drying gas is fed to the discharge tube 112 of the material to be dried. Then, the drying gas enters the drying space 119 through an opening arrangement 113. A connection to the gas transfer arrangement is above the shut-off arrangement, i.e. closer to the upper end of the discharge tube than the shut-off arrangement. The connection to the gas transfer arrangement is shielded so that material to be dried travelling along the discharge tube cannot enter the gas transfer arrangement.

As the drying gas travels through the material to be dried, it releases water vapour from the material to be dried, which vapour travels with the flow of the drying gas. When the water vapour enters in the drying space an area, where the material to be dried has rather newly been introduced into the body, i.e. the material is cooler than the material to be dried that has stayed longer in the dryer, water vapour condenses to the surface of the objects of material to be dried. In this process, the objects of material warm up in addition to moistening. Because the objects warm up, less energy is needed for the heating higher in the drying space. With the condensation of the water vapour also the advantage is achieved that when the material to be dried is plant material and as the surface of the objects of material becomes moistened, the epidermes open, whereby the drying of the inner parts of the object succeeds more easily.

In other embodiments of the invention, the discharge of the material to be dried from the upper part of the body can be done for example with a conveyor in connection of which there is a shut-off arrangement for preventing the drying gas from being removed.

In the drying process, values that are essential to the drying process are being measured and adjusted, such as temperatures, pressures, flow rates, the composition and the moisture of the drying gas. With these values, the process can be controlled so that the drying can be optimally adjusted for the material to be dried and for example to abide by the regulations concerning emissions and safety. To the monitoring of the drying process also the monitoring and the quenching of sparks can be combined.

The method according to the invention combines hot-air drying, vapour drying and heating, and maintenance of surface moisture of the material to be dried and utilization of the heat of the condensation reaction. When removed from the dryer, the temperature of the drying gas is somewhat higher than the temperature of the material to be dried being fed. The maximum temperature for the drying gas being removed is usually below 50° C. With other materials, the temperatures of the drying gas and of the material to be dried may be different. If air is used as drying gas, then a temperature increase of hundred degrees in the described temperature range binds approximately 31 g/m$^3$ of water. When drying wood products, the drying gas can be 160° C. at the exit from the heating arrangement. The temperature of the drying gas is adjusted such that the temperature of the wood product to be dried does not exceed 130° C.

The drying capacity can be set as to the temperature so that no volatile organic compounds (VOC) are released from the material to be dried, and that the epidermis of the material to be dried does not dry too early. Too fast drying of the epidermis slows down both the transfer of heat to the object to be dried and the water removal from the object to be dried. Volatile compounds (VOC) start to release from an object of organic origin as it is heated to a temperature considerably over hundred degrees. The drying gas can, however, be at a temperature considerably higher than the one in which VOC compounds are released, because the water vaporizing from the surface of the object to be dried keeps the temperature of the object to be dried cooler.

In order to achieve correct final moisture, for example final moisture of the material to be dried, amount of water removed from the dryer, relative humidity of the drying gas or temperatures at different areas of the dryer can be measured. According to the obtained measurement results, the drying process can be controlled either automatically or manually. For the automatic control of the drying process, different drying patterns can be prepared for different materials or for materials of different moistures or for materials of different object sizes. The drying patterns may contain different parameters and settings which are used to control the drying process. The drying process can be controlled by modifying for example the temperature or the flow of the drying gas or the flow of the material to be dried.

In the dryer according to the invention, higher drying gas temperatures can be used as compared to conventional drying methods. The surface moisture of the material to be dried is high in the stage of condensation of the water vapour. This improves the transfer of heat to the object to be dried. As the temperature of the object to be dried grows, the transfer of water from the inner parts of the object to the surface parts speeds up. The flow rates of the drying gas can be decreased by lowering the blowing power, whereby the flow rate of the drying gas in the material to be dried is decreased.

By fibre-saturation point (FSP) of wood is intended a state in which the wood is in maximum humidity, the relative humidity of the air being 100%. For Finnish woods, FSP is approximately 30%. The fastest drying result is obtained when the epidermis of an object of wood is maintained at FSP as long as possible during the drying process. In the final drying, the object to be dried can be dried to have in its surface parts considerably lower moisture than the aimed final moisture, the inner parts remaining wetter. The moisture of the object to be dried becomes even after the drying process relatively quickly, whereby the desired final moisture is achieved both in the surface and the inner parts.

As a drying gas, air can used but inertia gas can also be used.

The dryer according to the invention can be used in a continuous manner, i.e. when the material to be dried being highest in the dryer has reached a certain dryness, more material to be dried is fed to the lower part of the dryer, whereby material to be dried being highest is discharged from the dryer by means of a discharge arrangement at its upper part.

Some advantageous embodiments according to the invention have been described above. The invention is not limited to the solutions described above, but the inventive idea can be applied in numerous ways within the scope of the claims.

The invention claimed is:

1. A dryer (101) for drying objects of material, the dryer comprising:

a container-like body (102) that is in a substantially vertical or inclined position, a drying space (119) for a drying process, a feeding arrangement (104, 105) for the material to be dried in a lower part of the body, a discharge arrangement (113, 112) for the material to be dried in an upper part of the body, means (124) for directing drying gas into the body substantially in the upper part of the body, means for taking off the drying gas in the lower part of the body, and a sieve arrangement for allowing the drying gas and water to pass through, the sieve arrangement being in the lower part of the body, wherein said means for taking off the drying gas are under said sieve arrangement and the drying space (119) is arranged to be essentially full of material to be dried from the sieve arrangement up to the discharge arrangement of the material to be dried when dryer is in use, wherein the sieve arrangement (109) is substantially in the form of a funnel opening towards the upper part of the body and located above the feeding arrangement, wherein the sieve arrangement (109) is movable in the direction of a longitudinal axis of the body, and wherein the material to be dried is organic.

2. The dryer (101) according to claim 1, further comprising a circulation system (108) of a drying gas for circulating the drying gas, which circulation system is arranged to have a substantially closed circulation.

3. The dryer (101) according to claim 2, wherein in the circulation system (108) of the drying gas, there is at least one valve arrangement (110) for adding drying gas into the circulation system or for removing it from the circulation system.

4. The dryer (101) according to claim 2, wherein in the circulation system (108) of the drying gas, there is a heating device (111) for heating the drying gas.

5. The dryer (101) according to claim 4, wherein the heating device (111) is a gas-heated hot-air furnace.

6. The dryer (101) according to claim 1, in the feeding arrangement (104, 105) of the material to be dried, there is a shut-off arrangement (106), and in the discharge arrangement (113, 112), there is a shut-off arrangement (114, 116) for preventing the drying gas from being removed from the circulation system (108).

7. The dryer (101) according to claim 3, wherein in the circulation system (108) of the drying gas, there is a heating device (111) for heating the drying gas.

8. The dryer (101) according to claim 1, wherein a cross-section of the drying space (119) is growing in the travel direction of the material to be dried.

9. A method for drying objects of material, in which method the material to be dried is dried in a dryer (101), which has a container-like body (102) that is substantially in an upright position or in an inclined position, wherein the method works on a counter current principle in which the drying takes place in a drying space, the method comprising:

feeding the material to be dried to a lower part of the body, discharging the material to be dried is from an upper part of the body, directing a drying gas into the body of the dryer substantially at the upper part of the body and taking off the drying gas from the lower part of the body, wherein the drying gas and water go through a sieve arrangement and the drying space is above the sieve arrangement and it can be filled essentially full of material to be dried, wherein the sieve arrangement (109) is substantially in the form of a funnel opening towards the upper part of the body and located above the feeding arrangement, wherein the sieve arrangement (109) is movable in the direction of a longitudinal axis of the body, and wherein the material to be dried is organic.

10. The method according to claim 9, wherein the drying gas circulates in the dryer (101) in a substantially closed circulation.

11. The method according to claim 9, wherein the drying gas taken off from the lower part of the body (101) is heated by a heating device (111) and the heated drying gas is fed to the upper part of the body (102).

12. The method according to claim 9, wherein the drying gas carries water vapor released from the material to be dried in the upper part of the body (102) to the lower part of the body, where the water vapor is condensed to the surface of the material to be dried, releasing simultaneously heat to the material to be dried.

13. The method according to claim 9, wherein the objects of the organic material to be dried by the method are at least one of logs of wood, wood chips, pellets, saw dust, peat, and pressed pieces.

* * * * *